United States Patent [19]

Munch Jensen

[11] Patent Number: 4,553,662

[45] Date of Patent: Nov. 19, 1985

[54] APPARATUS FOR FEEDING PIECES OF LAUNDRY ON A CONVEYOR

[75] Inventor: Jorn Munch Jensen, Bern, Switzerland

[73] Assignee: Ejnar Jensen & Son Maskinfabrik A/S, Ronne, Denmark

[21] Appl. No.: 530,130

[22] Filed: Sep. 7, 1983

[30] Foreign Application Priority Data

Sep. 14, 1982 [DK] Denmark ..... 4093/82

[51] Int. Cl.[4] ..... B65G 47/26

[52] U.S. Cl. ..... 198/456; 198/468.5; 414/13; 271/267

[58] Field of Search ..... 198/456, 689; 271/276, 271/275, 267, 84; 38/143; 414/13, 72, 73, 752; 901/40

[56] References Cited

U.S. PATENT DOCUMENTS

| | | | |
|---|---|---|---|
| 3,035,695 | 5/1962 | Buchwald et al. | 198/689 X |
| 3,414,997 | 12/1968 | Henry | 38/143 |
| 3,421,756 | 1/1969 | Weir | 38/143 |
| 3,431,665 | 3/1969 | Weir | 38/143 |
| 3,735,512 | 5/1973 | Ross | 38/143 |
| 3,860,233 | 1/1975 | Wiase | 271/239 |
| 4,466,531 | 8/1984 | Baugher et al. | 198/486 |

FOREIGN PATENT DOCUMENTS 2081749 2/1982 United Kingdom .

*Primary Examiner*—Robert J. Spar
*Assistant Examiner*—Jonathan D. Holmes
*Attorney, Agent, or Firm*—Murray, Whisenhunt and Ferguson

[57] ABSTRACT

An apparatus for the centered feeding of pieces of laundry to a conveyor comprises a support for hangingly supporting a piece of laundry to be fed to the conveyor, the support is reciprocally movable parallel to the centerline of the conveyor between a first position where a front face of the support is in front of the conveyor and a second position where the front face is disposed above the conveyor. The support comprises a hollow body with a front face formed by a belt with apertures therethrough. The belt is movable transversely of the conveyor centerline and the hollow body. A vacuum source is connected to the hollow body through a valve. Application of vacuum pressure to the hollow body allows an edge of a piece of laundry to be held against the apertured belt. Transverse movement of the belt allows centering of the piece of laundry with respect to the conveyor centerline. After centering, the support is moved to the second position, vacuum pressure is released and the edge of the laundry piece is allowed to fall onto the conveyor in centered relation thereto.

6 Claims, 3 Drawing Figures

APPARATUS FOR FEEDING PIECES OF LAUNDRY ON A CONVEYOR

Figure 1:
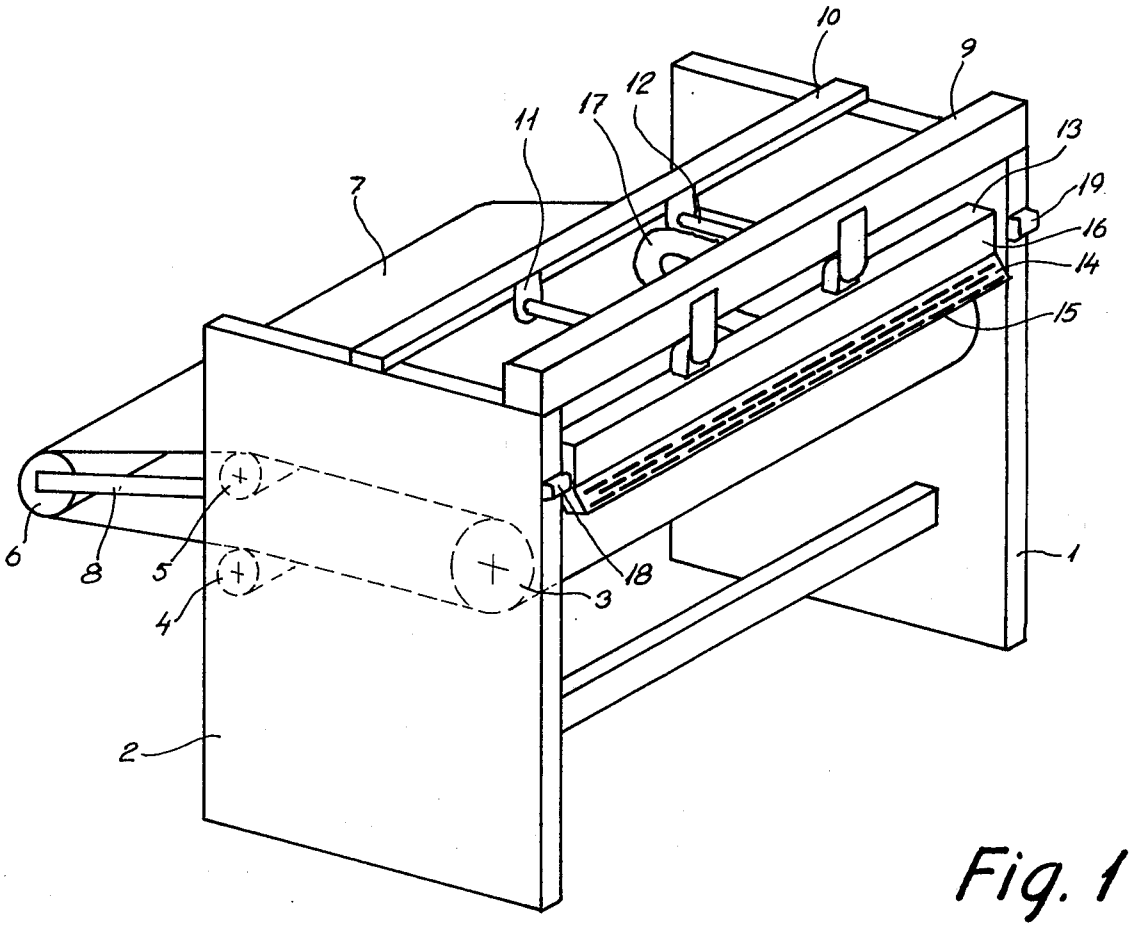

The present invention relates to an apparatus for centered feeding of pieces of laundry to a conveyor.

Normally laundry is fed to ironing machines and folding machines by means of feeders comprising a conveyor, to which the separate pieces of laundry are transferred after having been inserted with two corners in a pair of clamps, which are then moved apart to straighten out the leading edge of the piece of laundry. Thereafter the piece of laundry is transferred to the conveyor by transfer means, several types of which are known. A known type is a hollow body with openings on one face and connected with a vacuum source, which hollow body is adapted to move from a position in front of the conveyor to a position above the conveyor, in which the vacuum is cut off.

When feeding smaller pieces of laundry, which in this connection means pieces, which are so small that the leading edge of the piece may be straightened out between the hands of an operator, feeding apparatus, in which the laundry is inserted at two corners, are normally not used, but the separate pieces are placed directly on a conveyor manually. Thereby, however, the advantage of a centered feeding provided by the pair of clamps is lost.

The object of the present invention is to provide an apparatus of the aforementioned type, but offering a centering of the pieces of laundry in spite of the fact that they are placed manually on the apparatus with a straight leading edge only.

According to the invention this is obtained if the portion of the body with the openings is displacable in the direction of the holding means.

With the apparatus according to the invention, the manual feeding need not be very accurate. The apparatus may compensate for deficiencies in centering and takes care of correct timing of the feeding procedure. Relieving the operator's attention from these tasks makes possible a considerable increase in the productivity of the operator, which is advantageous for the economy of the line of ironing and folding apparatuses fed by means of the feeding apparatus.

Preferably according to the invention the portion of the body with openings is a displacable belt distended in a track in the hollow body. This embodiment is especially advantageous in case a number of hollow bodies are placed side by side, as the centering movement will not require space at the sides of the hollow bodies.

According to the invention the dispacement is controlled by means of sensing means. This provides a direct measurement which may be used as input for driving means for the displacement of the belt.

The sensing means may according to the invention be adapted to register an intensity of light. By comparing the amounts of light on the not covered portion of the faces of a pair of prisms placed symmetrically on the hollow body a control signal for a centering may be obtained.

The preferred sensing means comprise a differential pressure sensor. In this arrangement the vacuum holding the piece of laundry is used directly for measurement of the placing of the piece of laundry.

As the difference in pressure used for centering the belt before the piece of laundry is placed is very small, it is preferred according to the invention to use a third chamber arranged between the chambers connected with the sensor. This will provide an increase of the pressure differential for the centering owing to a reduction of the area of the openings.

The belt may, however, also in accordance with the invention, be endless and consequently need not be centered between the feeding operations.

The invention is described in detail with reference to the drawing, in which

Figure 2:
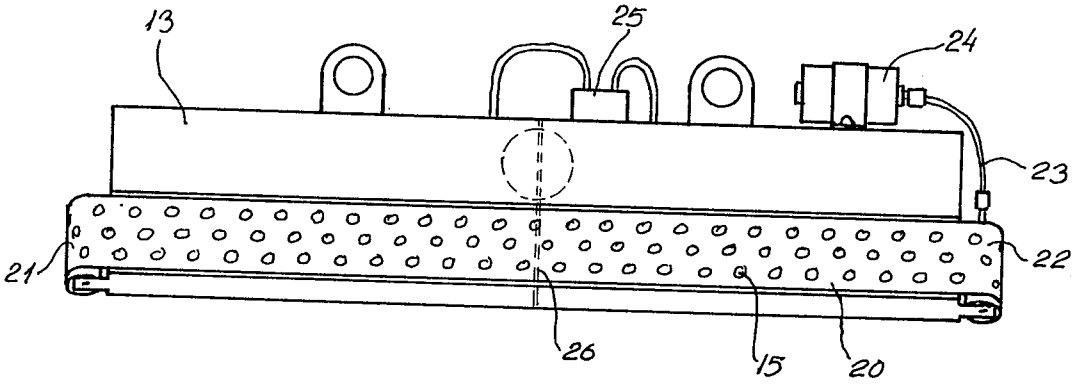
Figure 3:
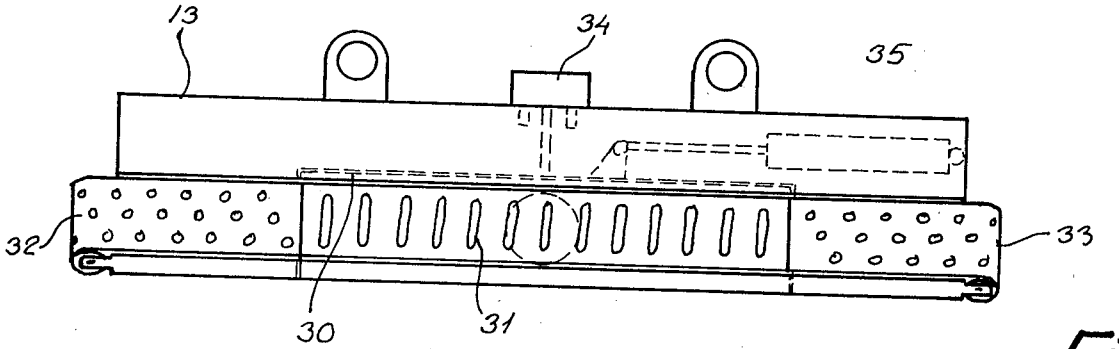

FIG. 1 is an illustration in perspective of the apparatus according to the invention, FIG. 2 is a front view of a hollow body in a first embodiment, and FIG. 3 is a front view of another embodiment of a hollow body.

The apparatus according to the invention is shown in FIG. 1. The apparatus comprises a frame with two side members 1 and 2, between which a conveyor belt 7 is carried by a number of rollers 3,4,5, and 6. The roller 6 is carried by a pair of arms 8, which are pivotable in order to enable the roller 6 to be lifted or lowered, so that the height, at which the the pieces of laundry transported by the conveyor after being fed at the leading roller 3, may be adjusted. Above the conveyor the side members 1,2 are interconnected by means of two beams 9 and 10. The front beam 10, placed in front of the leading edge of the conveyor 7, is tube-shaped. This tube is part of a vacuumline and is by means of pipes or tubes not shown connected to a vacuum source providing a vacuum of approximately 0.1 Bar.

Between the two beams 9 and 10 two parallel guides 11 and 12 are mounted, on which guides a hollow body 13 is movable from a foremost position, shown in FIG. 1, in which the front face of the body is placed in front of the front roller 3, to a rearmost position, in which the hollow body 13 is above the conveyor 7 and some distance behind the front roller. In the side members, or along the guides, driving means are arranged, which driving means may drive the body backwards at a speed slightly exceeding the speed of the conveyor.

The hollow body 13 is a tube closed at both ends with a sloping, forward facing side 14, which is provided with one or more elongated openings 15 or perforations comprising a number of rows of closely spaced holes. Above the sloping side 14 a vertical face 16 is arranged. The tube is closed at its top, at its rear side and its underside in such a way that the tube is comparatively slim. The closing at its underside is shaped in such a way that it does not protrude below the lower edge of the sloping face 14. The suspension of the tube 13 is arranged in such a way that the tube passes the conveyor belt closely above it. The tube 13 is connected with the hollow beam 9 by means of a flexible tube. In the connecting piece, which connects the tube 16 with the beam, a butterfly-valve is mounted. At the front edges of the side members 1 and 2 a light emitter 18 is placed as well as a photosensor 19, adapted to register when something is brought close to the sloping face 14.

The operation of the apparatus when feeding pieces of laundry is as follows: An operator brings a piece of laundry with an edge held straight close to the sloping face 14. As soon as the light beam between the light emitter 18 and the photosensor 19 is broken the butterfly-valve in the tube 17 is opened. The hollow body is thereby connected with the vacuum source. As soon as the piece of laundry hits the sloping face 14, its leading edge will immediately be sucked against the face owing to the perforations 15. The piece of laundry is placed with its leading edge along the vertical face 16. When the operator releases the piece of laundry and moves his hands away the light beam will again be unbroken, and the photosensor will activate the movement of the hollow body 13 above the conveyor 7. Shortly before the body 13 changes its direction of movement, the butterfly-valve in the tube 16 is closed, the piece of laundry thereby being released. The piece of laundry is then delivered on the conveyor with an overlap sufficient for conveying the piece in spite of the fact that a trailing portion thereof is hanging down from the front roller 3. When the hollow body has returned to its staring position, the apparatus is ready for a new cycle as soon as a photosensor (not shown) at the leading edge of the conveyor is illuminated again, which indicates that the trailing edge of the former piece of laundry has passed the front roller 3.

In FIG. 2 a special embodiment of the hollow body 13 is shown with an arrangement for centering the piece of laundry being placed over the holes 15. The centering is performed by means of a belt 20 displacable in the longitudinal direction of the body 13, in which belt the holes 15 are present. The belt 20 is displaced by driving means which may be arranged in a number of ways. For example a hydraulic cylinder may be used or a threaded spindle connected with one end of the belt 20, which is bent around a roller 21 placed at one end of the body 13, while the other end is connected with a spring and bent around a roller 22 at the other end of the body 13. The belt may also be endless, and one of the rollers may be adapted to drive the belt, for example by being connected to a motor by means of a flexible shaft 23. The motor is controlled by means of impulses from a sensor 25 for differential pressure, which is by means of flexible tubes connected with the two ends of the hollow body 13. In order to provide a pressure difference between the two ends a separating wall 26 is placed at the connecting piece of the tube 16. If the piece of laundry is placed in such a way that it covers areas of different size of the belt on the two sides of the separating wall 26, a pressure difference will prevail between the two ends of the body 13. This will activate the the motor 24 and displace the belt in a direction, which reduces the pressure difference. When the pressure difference is eliminated, it implicates that the piece of laundry must be placed centrally with respect to the separating wall 26. If an endless belt is used, there will be no need for centering the belt before placing the piece of laundry. However, if a driving means with a limited stroke is used, the belt must be centered before the piece is placed on the belt.

In FIG. 3 a displacement arrangement with centering of the belt before the placing of the piece of laundry is shown. In the central part of the hollow body a chamber 30 is arranged, the chamber being displacable with respect to the hollow body 13. The chamber has a front face with perforations 31. The belt is connected with the ends of the chamber and bent around rollers 32,33 to the rear side of the hollow body. The chamber is via the tube 16 connected with the vacuum source. The two ends of the body are also connected with the tube 16 and are furthermore connected with the two sides of a sensor 34 for pressure differentials. The sensor 34 delivers a signal, which is used for controlling the oil supply to a hydraulic cylinder 35, displacing the chamber 30.

Instead of sensing differential pressures in different parts of the hollow body 13 other forms of measuring may be used. For example, the difference of light on two bodies placed under the body 13 may be measured, and the output signal from a differential amplifier receiving the output from two photoresistors, may be used for activating the motor 24 or the cylinder 35 in an arrangement corresponding to the output from the pressure sensor.

I claim:

1. In an apparatus for the centered feeding of pieces of laundry to a conveyor having a centerline comprising holding means for hangingly supporting a piece of laundry to be fed to said conveyor, said holding means comprising a hollow body having a front face with a plurality of apertures therethrough, said front face disposed transversely to said conveyor centerline, said holding means being reciprocally movable, parallel to said conveyor centerline, between a first position wherein said front face is in front of said conveyor and a second position wherein said front face is disposed above said conveyor; a vacuum source; valve means for connecting said vacuum source to said hollow body and controlling the application of vacuum to said hollow body; the improvement comprising:

said front face comprising a movable member having apertures therethrough, said movable member being movable transversely with respect to said conveyor centerline and said hollow body; and displacement means for moving said movable member transversely with respect to said conveyor centerline, whereby an edge of a piece of laundry to be fed to said conveyor may be held against said movable member by vacuum pressure and centered with respect to said conveyor centerline by transverse movement of said movable member, when said holding means is in said first position, and then said holding means may be moved to said second position and said edge of said piece of laundry may be dropped upon said conveyor, by release of vacuum pressure, in centered relation thereto.

2. The apparatus as claimed in claim 1, wherein said movable member comprises a belt distended along the front of said hollow body and movable transversely of said conveyor centerline.

3. The apparatus as claimed in claim 2, wherein said belt is an endless belt.

4. The apparatus as claimed in claim 1, further comprising sensing means for sensing whether a piece of laundry is centered with respect to said conveyor centerline and providing a control signal to cause said displacement means to move said movable member to center said piece of laundry with respect to said conveyor centerline.

5. The apparatus as claimed in claim 4, wherein said hollow body is divided transversely into at least two chambers, each chamber connected to said valve means, the outermost chambers relative to the conveyor centerline in the transverse direction being connected to said sensing means, said sensing means comprising a differential pressure sensor for detecting the pressure differential between said outermost chambers.

6. The apparatus as claimed in claim 4, wherein said hollow body is divided into three chambers, each chamber connected to said valve means, one of said chambers connected to and movable with said movable member, the other two chambers connected to said sensing means, said sensing means comprising a differential pressure sensor for detecting the pressure differential between said other two chambers.

* * * * *